US006851984B2

(12) United States Patent
Chang

(10) Patent No.: US 6,851,984 B2
(45) Date of Patent: Feb. 8, 2005

(54) STRUCTURE OF ELECTRICAL CONNECTOR

(75) Inventor: Chih-Kai Chang, Taoyuan Hsien (TW)

(73) Assignee: Speed Tech Corp., Taoyuan Hsien (TW)

( * ) Notice: Subject to any disclaimer, the term of this patent is extended or adjusted under 35 U.S.C. 154(b) by 0 days.

(21) Appl. No.: 10/663,659

(22) Filed: Sep. 17, 2003

(65) Prior Publication Data

US 2004/0082228 A1 Apr. 29, 2004

(30) Foreign Application Priority Data

Oct. 29, 2002 (TW) ..... 91217349 U

(51) Int. Cl.[7] ..... H01R 24/00
(52) U.S. Cl. ..... 439/676; 439/941
(58) Field of Search ..... 439/676, 941

(56) References Cited

U.S. PATENT DOCUMENTS 4,556,264 A * 12/1985 Tanaka ..... 439/62
5,403,207 A * 4/1995 Briones ..... 439/620
5,885,111 A * 3/1999 Yu ..... 439/676
6,093,060 A * 7/2000 Wiebking et al. ..... 439/676
6,402,563 B1 * 6/2002 Shi et al. ..... 439/676
2002/0146940 A1 * 10/2002 Colantuono et al. ..... 439/676

* cited by examiner

*Primary Examiner*—Hae Moon Hyeon

(57) ABSTRACT

A structure of an electrical connector for network signal transmission is constructed to include an electrically insulative housing, which has a front receiving side, a recessed rear mounting side, insertion holes extended between the front receiving side and the rear mounting side, and a finger unit backwardly extended from the rear mounting side, terminals mounted in the insertion holes and suspended in the front receiving side of the housing, and a back cover detachably press-fitted into the recessed rear mounting side of the housing to hold down respective rear soldering portions of the terminals.

13 Claims, 7 Drawing Sheets

STRUCTURE OF ELECTRICAL CONNECTOR

This nonprovisional application claims priority under 35 U.S.C. §119(a) on Patent Application No. 091217349 filed in Taiwan on Oct. 29, 2002, which is herein incorporated by reference.

BACKGROUND OF THE INVENTION

1. Field of the Invention

The present invention relates to a structure of an electrical connector for use in a computer network and, more particularly to a structure of an electrical connector, which uses finger means to detachably secure the back cover to the housing, holding down the terminals positively in position inside the housing.

2. Description of the Related Art

Following fast development of computer technology, a variety of sophisticated connectors for use in a computer network has been disclosed. Frequently plug and pull action between matched connectors may cause a distortion of the terminals, resulting in an interruption or inaccuracy of signal transmission. Therefore, when designing an electrical connector, the following factors must be well considered.

(1) How to lower the cost and reduce the number of component parts.

(2) How to have the component parts to be conveniently installed.

(3) How to make the assembly detachable.

FIG. 7 is an exploded view of an electrical connector according to the prior art. According to this design, the electrical connector comprises an electrically insulative housing A, the housing A having two backwardly extended retaining arms A1, a terminal holder B mounted in the housing A, a back cover C fastened to the rear side of the housing A, and a metal shield D covering the housing A and the back cover C. The terminal holder B comprises a first holder block B1 holding a set of contact terminals B11, and a second holder block B2 holding a set of mounting terminals B21. The back cover C is soldered to the contact terminals B11 and the mounting terminals B21. This design of electrical connector is complicated, resulting in a high manufacturing cost and complicated in installation procedures. Because signal is transmitted from the contact terminals B11 to the circuit board in which the mounting terminals B21 are installed via the back cover C, the signal in transmission tends to be interfered with external noises, thereby causing an instability or interruption of signal transmission. Further, the connection between the contact terminals B11 and the mounting terminals B21 tend to be broken.

Therefore, it is desirable to provide an electrical connector that eliminates the aforesaid drawbacks.

SUMMARY OF THE INVENTION

The present invention has been accomplished under the circumstances in view.

It is the main object of the present invention to provide a structure of an electrical connector, which is simple and inexpensive to manufacture.

It is another object of the present invention to provide a structure of an electrical connector, which is detachable.

To achieve these objects of the present invention, the electrical connector comprises an electrically insulative housing, comprising a front receiving side, a recessed rear mounting side, and a plurality of insertion holes extended from the front receiving side to the rear mounting side, a plurality of terminals respectively mounted in the recessed rear mounting side of the housing, the terminals each comprising a horizontally extended mounting portion positioned inside the housing, a front contact portion curved obliquely backwards from a front end of the mounting portion and a soldering portion downwardly extended from a rear end of the mounting portion, the passageways in between the spacer blocks to the outside of the housing for soldering to a circuit board; and a back cover press-fitted into the recessed rear mounting side of the housing to hold the terminals, and the back cover comprising at least one flat pressure wall adapted to hold down the soldering portions of the terminals in the recessed rear mounting side of the housing.

DETAILED DESCRIPTION OF THE PREFERRED EMBODIMENT

Figure 1:
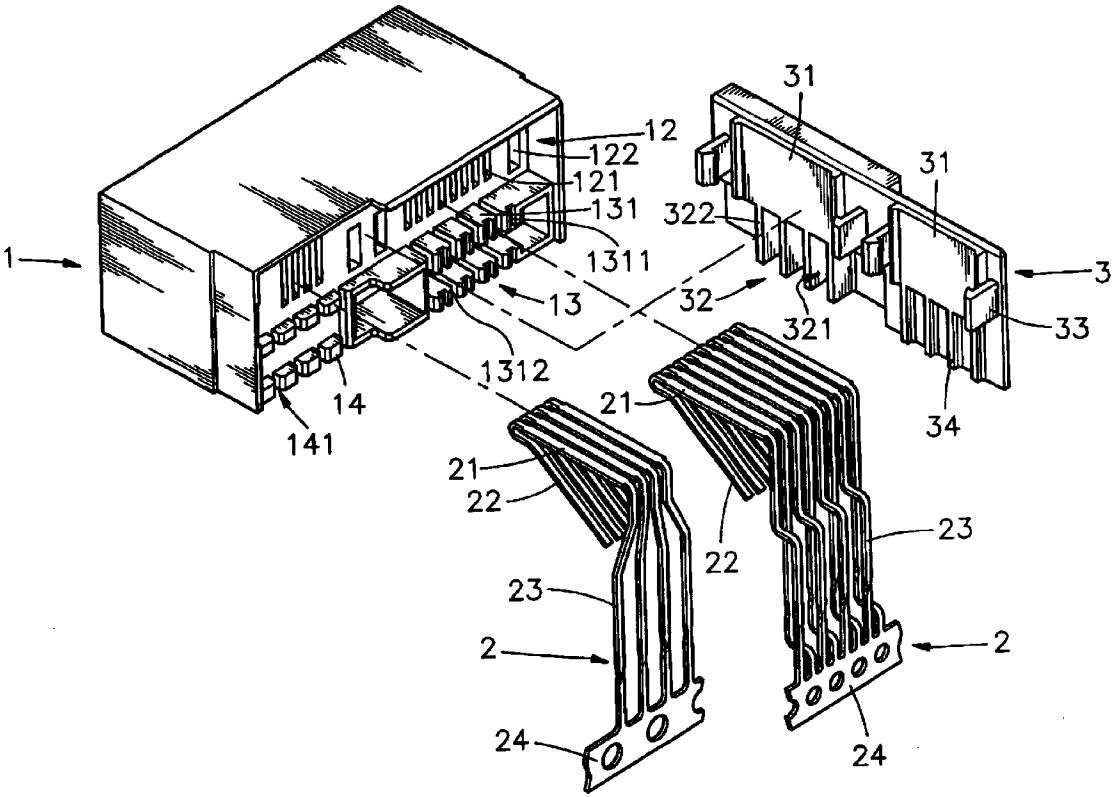
FIG. 1 is an exploded view of an electrical connector according to the present invention.
Figure 2:
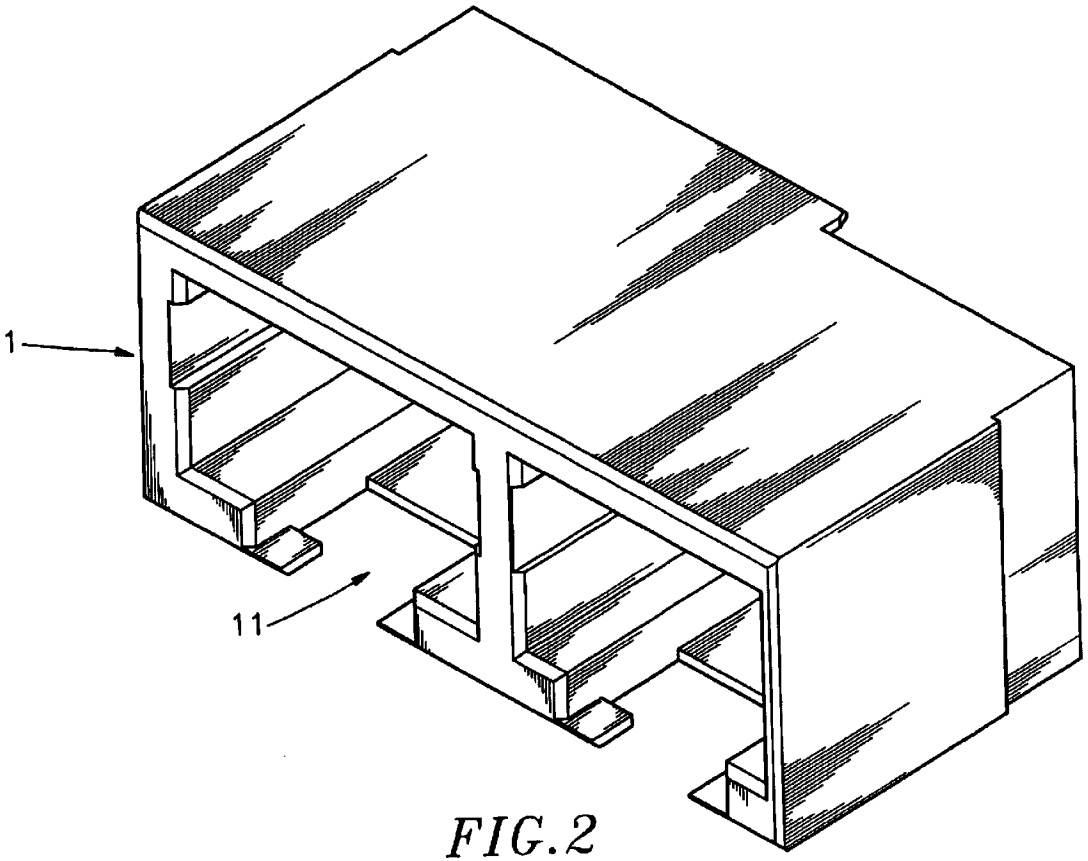
FIG. 2 is an oblique front elevation in an enlarged scale of the housing for the electrical connector shown in FIG. 1.
Figure 3:
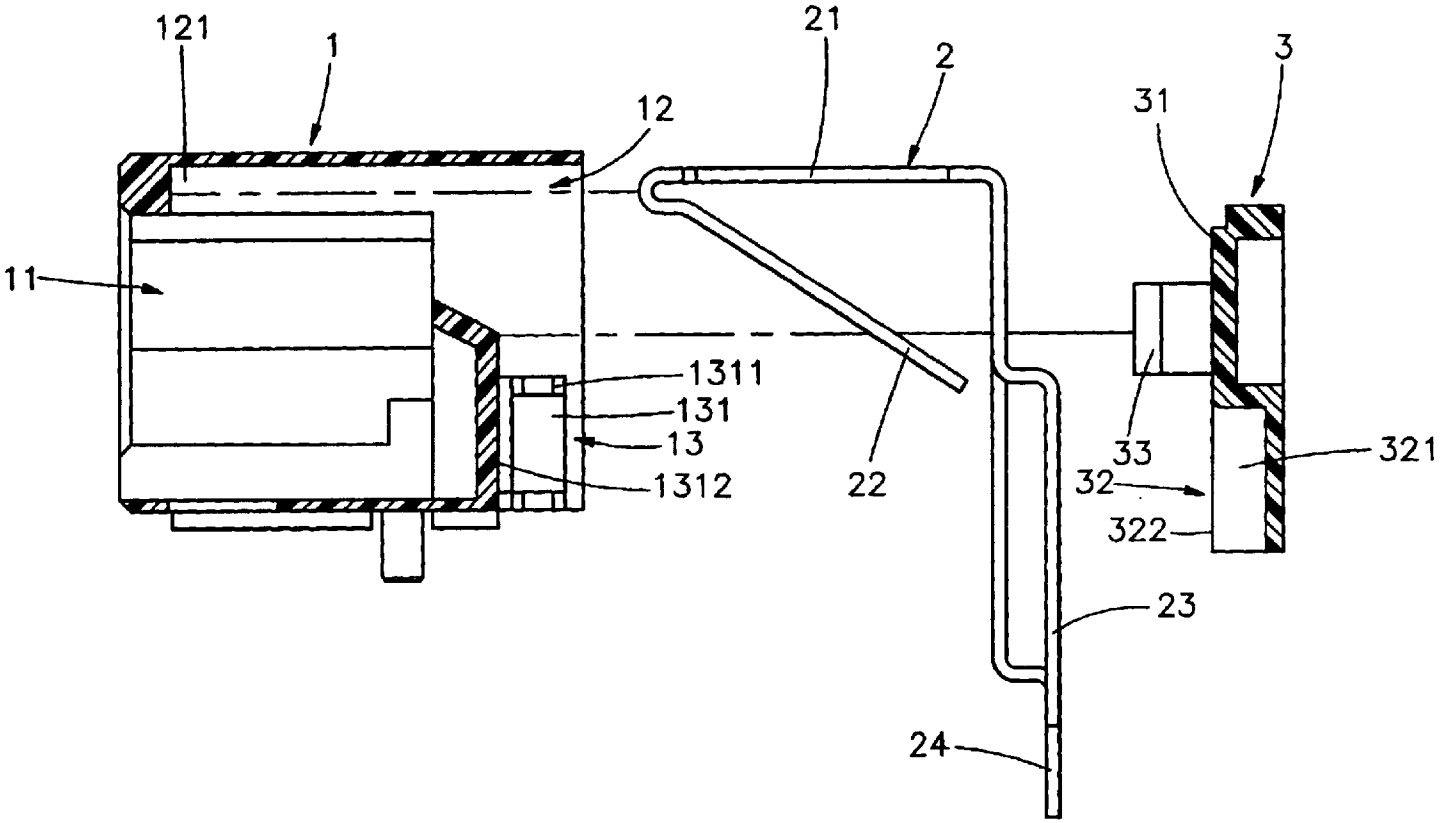
FIG. 3 is an exploded side view in section of the electrical connector according to the present invention.
Figure 4:
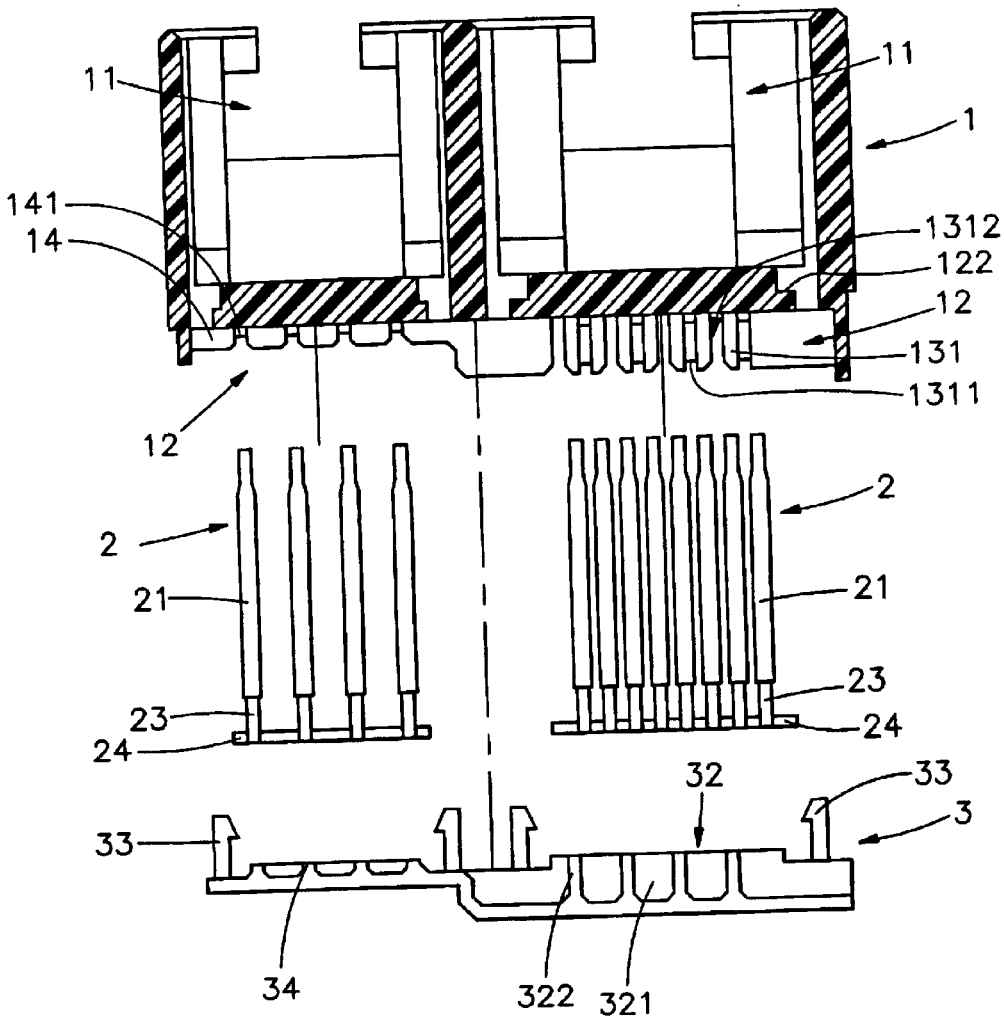
FIG. 4 is an exploded top view in section of the electrical connector according to the present invention.

Referring to FIGS. 1~4, the electrical connector in accordance with the present invention comprises an electrically insulative housing 1, a plurality of terminals 2 mounted in the housing 1, and a back cover 3 fastened to the back side of the housing 1 to hold down the terminals 2.

The housing 1 has a front receiving side 11, a recessed rear mounting side 12, a plurality of insertion holes 121 extended from the front receiving side 11 to the rear mounting side 12, a plurality of hook holes 122 formed in the rear mounting side 12, a finger unit 13 backwardly extended from the rear mounting side 12, a plurality of protruding blocks 14 suspended in the rear mounting side 12, and a plurality of passageways 141 respectively defined in between each two adjacent protruding blocks 14. The finger unit 13 comprises a plurality of spacer blocks 131, and a plurality of passageways 1312 respectively defined in between each two adjacent spacer blocks 131. Each spacer block 131 has a front locating groove 1311.

The terminals 2 each comprise a horizontally extended mounting portion 21, a front contact portion 22 curved obliquely backwards from the front end of the mounting portion 21, a rear vertical soldering portion 23 curved downwards from the rear end of the mounting portion 21 and terminating in a material bar 24. According to this embodiment, the terminals 2 are arranged into two sets each set having a material bar 24 connected to the rear vertical soldering portions 23 of the respective terminals 2.

The back cover 3 comprises two flat pressure walls 31 in the front side, a plurality of hooks 33 forwardly extended from the front side corresponding to the hook holes 122 in the housing 1, a finger unit 32 formed in the front side below one of the flat pressure walls 31 and a plurality of vertical partition flanges 34 formed in the front side below the other of the flat pressure walls 31. The finger unit 32 comprises a plurality of receiving open chambers 321 and partition flanges 322 alternatively arranged below the flat pressure walls 31.

Figure 5:
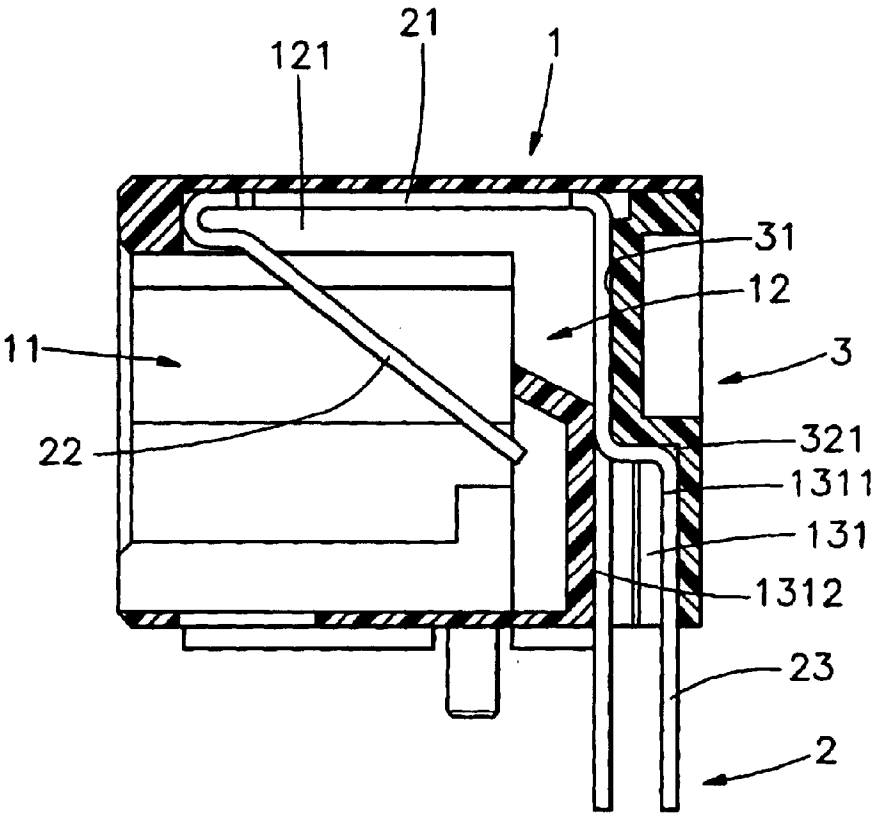
FIG. 5 is a sectional side view of the present invention showing the electrical connector assembled.
Figure 6:
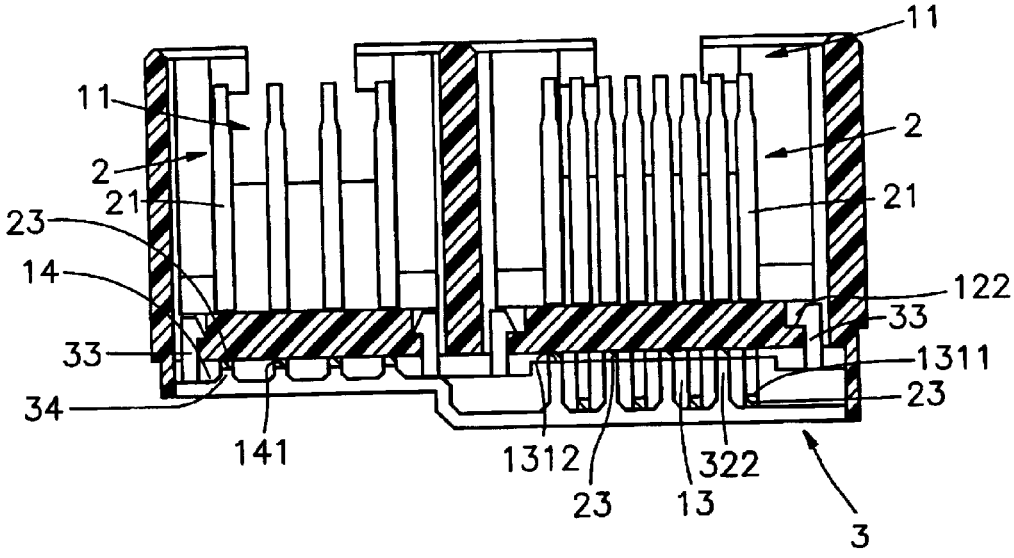
FIG. 6 is a top view in section of the present invention showing the electrical connector assembled.
Figure 7:
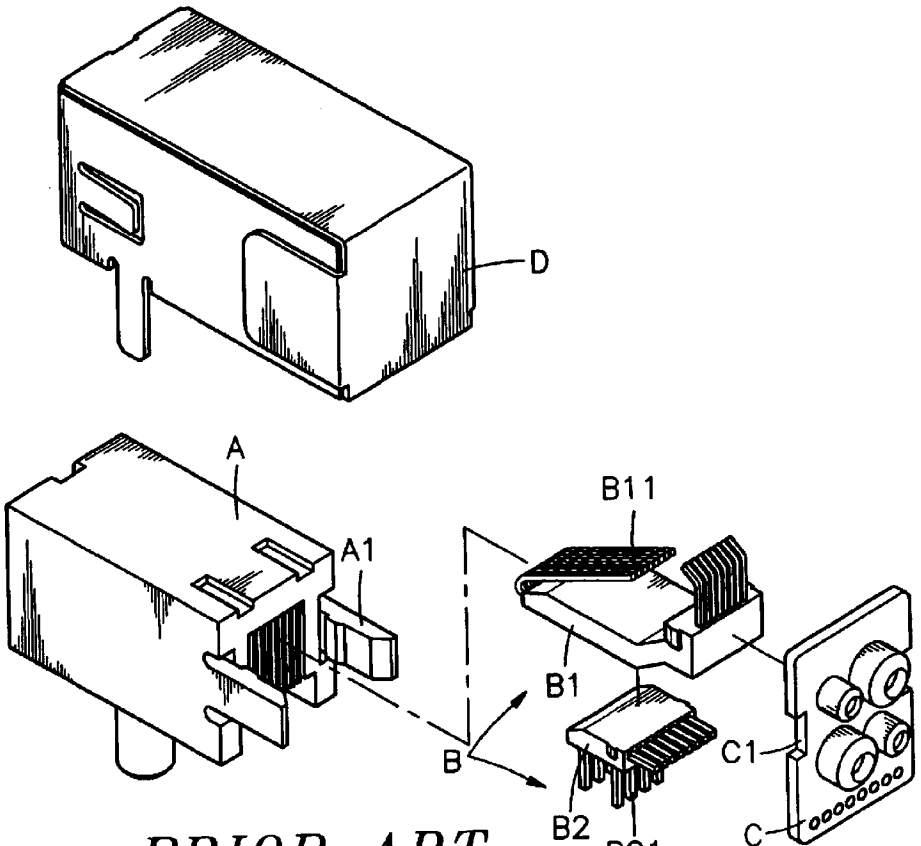
PRIOR ART FIG. 7
FIG. 7 is an exploded view of an electrical connector according to the prior art.

Referring to FIGS. 5 and 6, the terminals 2 are mounted in the rear mounting side 12 of the housing 1 to force the mounting portions 21 into the insertion holes 121 of the housing 1 respectively, keeping the front contact portions 22 of the terminals 2 respectively suspended in the front receiving side 11 of the housing 1 and the rear vertical soldering portions 23 of the respective terminals 2 respectively positioned in the passageways 1312 in between the spacer blocks 131 and the front locating grooves 1311 of the spacer block 131 and the passageways 141 in between the protruding blocks 14, and then the back cover 3 is press-fitted into the rear mounting side 12 to engage the hooks 33 into the respective hook holes 122 in the housing 1, keeping the spacer blocks 131 of the finger unit 13 of the housing 1 respectively engaged into the receiving open chambers 321 of the finger unit 32 of the back cover 3 and the partition flanges 322 of the back cover 3 respectively engaged into the passageways 1312 in between the spacer blocks 131 of the finger unit 13 of the housing 1 and the passageways 141 in between the protruding blocks 14.

At this time, the flat pressure walls 31 of the back cover 3 hold down the rear vertical soldering portions 23 of the terminals 2 in the passageways 1312 and the front locating grooves 1311 firmly. After installation of the back cover 3, the material bars 24 are separated from the rear vertical soldering portions 23 of the terminals 2, for enabling the rear vertical soldering portions 23 of the terminals 2 to be respectively soldered to a circuit board (not shown).

The aforesaid design can be employed to any of a variety of network connectors (for example RJ-45 and RJ-11). The aforesaid preferred embodiment is a combination of RJ-45 and RJ-11. Alternatively, the connector of the present invention can be made in the form of a RJ-45 connector or RJ-11 connector independently. The main feature of the present invention is the design of the flat pressure walls 31 and finger unit 32 of the back cover 3 adapted to hold down the terminals 2 firmly in the rear mounting side 12 of the housing 1.

A prototype of electrical connector has been constructed with the features of FIGS. 1~6. The electrical connector functions smoothly to provide all of the features discussed earlier. from the spirit and scope of the invention. Accordingly, the invention is not to be limited except as by the appended claims.

What the invention claimed is:

1. A structure of a electrical connector comprising:

an electrically insulative housing, said housing comprising a front receiving side, a recessed rear mounting side, a plurality of insertion holes extended from said front receiving side to said rear mounting side, and a finger unit backwardly extended from said rear mounting side, wherein the finger unit comprises a plurality of spacer blocks, and wherein a passageway is formed between every two adjacent spacer blocks;

a plurality of terminals respectively mounted in said recessed rear mounting side of said housing, said terminals each comprising a horizontally extended mounting portion positioned inside said housing, a front contact portion curved obliquely backwards from a front end of said mounting portion, and a rear vertical soldering portion downwardly extended from a rear end of said mounting portion passing through the passageways between said spacer blocks to the outside of said housing for soldering to a circuit board; and a back cover press-fitted into said recessed rear mounting side of said housing to hold down said terminals, said back cover comprising at least one flat pressure wall adapted to hold down the rear vertical soldering portions of said terminals in the recessed rear mounting side of said housing, and a finger unit forced into engagement with the finger unit of said housing to hold down said terminals.

2. The structure of the electrical connector as claim 1, wherein said housing further comprises a plurality of hook holes formed in said recessed rear mounting side; said back cover further comprises a plurality of hooks respectively hooked in the hook holes of said housing.

3. The structure of the electrical connector as claim 1, wherein the finger unit of said housing comprises a plurality of spacer blocks, and a plurality of passageways respectively defined in between each two adjacent spacer blocks, said spacer blocks each having a front locating groove; the finger unit of said back cover comprises a plurality of receiving open chambers, which receive the spacer blocks of the finger unit of said housing, and a plurality of partition flanges, which separate said receiving open chamber.

4. The structure of the electrical connector as claim 3, wherein the passageways in between the spacer blocks of the finger unit of said housing and the front locating grooves of said spacer blocks of said housing receive the rear vertical soldering portions of said terminals, and the partition flanges of the finger unit of said back cover are respectively engaged into the passageways of said housing to hold down the rear vertical soldering portions of said terminals.

5. The structure of the electrical connector as claim 1, wherein the mounting portions of said terminals are respectively positioned in the insertion holes of said housing.

6. The structure of the electrical connector as claim 1, wherein the front contact portions of said terminals are respectively suspended in the front receiving side of said housing.

7. The structure of the electrical connector as claim 1, which is a RJ-45 connector.

8. A structure of a electrical connector comprising:

an electrically insulative housing, said housing comprising a front receiving side, a recessed rear mounting side, a plurality of insertion holes extended from said front receiving side to said rear mounting side, a plurality of protruding blocks extending from said rear mounting side, and a passageway respectively formed between every two adjacent protruding blocks;

a plurality of terminals respectively mounted in said recessed rear mounting side of said housing, said terminals each comprising a horizontally extended mounting portion positioned inside said housing, a front contact portion curved obliquely backwards from a front end of said mounting portion, and a rear vertical soldering portion downwardly extended from a rear end of said rear mounting side passing through the passageways between said protruding blocks to the outside of said housing for soldering to a circuit board; and a back cover press-fitted into said recessed rear mounting side of said housing to hold down said terminals, said back cover comprising a flat pressure wall and a plurality of partition flanges adapted to hold down the soldering portions of said terminals in the rear mounting side of said housing.

9. The structure of the electrical connector as claim 8, wherein said housing further comprises a plurality of hook holes formed in said recessed rear mounting side; said back cover further comprises a plurality of hooks respectively hooked in the hook holes of said housing.

10. The structure of the electrical connector as claim 8, the passageways in between the protruding blocks receive the rear vertical soldering portions of said terminals, and the partition flanges of said back cover are respectively engaged into the passageways of said housing to hold down the rear vertical soldering portions of said terminals.

11. The structure of the electrical connector as claim 8, wherein the mounting portions of said terminals are respectively positioned in the insertion holes of said housing.

12. The structure of the electrical connector as claim 8, wherein the front contact portions of said terminals are respectively suspended in the front receiving side of said housing.

13. The structure of the electrical connector as claim 8, which is a RJ-11 connector.

* * * * *